US011050185B2

(12) United States Patent
Minamino

(10) Patent No.: US 11,050,185 B2
(45) Date of Patent: Jun. 29, 2021

(54) CONNECTOR

(71) Applicant: Yazaki Corporation, Tokyo (JP)

(72) Inventor: Yuya Minamino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/812,148

(22) Filed: Mar. 6, 2020

(65) Prior Publication Data

US 2020/0295504 A1 Sep. 17, 2020

(30) Foreign Application Priority Data

Mar. 11, 2019 (JP) ..... JP2019-043287

(51) Int. Cl.
*H01R 13/52* (2006.01)

(52) U.S. Cl.
CPC ..... *H01R 13/5219* (2013.01)

(58) Field of Classification Search
CPC ..... H01R 13/5219
USPC ..... 439/278
See application file for complete search history.

(56) References Cited

U.S. PATENT DOCUMENTS 5,158,391 A * 10/1992 Fujitani ..... H01R 13/5202 403/288
5,197,898 A 3/1993 Nagamine
6,257,592 B1 * 7/2001 Hashizawa ..... F16J 15/061 277/596
6,921,292 B2 * 7/2005 Miyazaki ..... H01R 9/032 439/564
6,953,357 B2 * 10/2005 Fukushima ..... H01R 13/5219 439/271
7,329,145 B2 * 2/2008 Yagome ..... H01R 13/506 439/271
7,586,227 B2 * 9/2009 Spaggiari ..... H02K 5/10 310/85
8,747,137 B2 * 6/2014 Tashiro ..... H01R 13/5202 439/271
9,059,534 B2 * 6/2015 Endo ..... H01R 13/5205
9,083,107 B2 * 7/2015 Suzuki ..... H01R 13/5202
9,130,298 B1 * 9/2015 Baydoun ..... H01R 13/5202
(Continued)

FOREIGN PATENT DOCUMENTS

JP H5-326066 A 12/1993
JP 2004-327169 A 11/2004
(Continued)

*Primary Examiner* — Peter G Leigh
(74) *Attorney, Agent, or Firm* — Kenealy Vaidya LLP

(57) ABSTRACT

A connector includes a packing that includes a seal portion having an annular shape and a piece portion protruding from the seal portion and having a through-hole, and a fitting portion that holds a terminal, is mounted with the packing, and is fitted to a target to be fitted so that a space between the fitting portion and the target to be fitted is sealed by the packing. The fitting portion includes a first member that includes a cylindrical portion having an outer surface on which the seal portion is mounted, a second member that is attached to the cylindrical portion, a projection portion provided in one member of the first and second members, is inserted into the through-hole, and includes a tip projecting from the through-hole, and an opening portion provided in the other member of the first and second members and into which the tip is inserted.

10 Claims, 8 Drawing Sheets

(56) References Cited

U.S. PATENT DOCUMENTS

| | | | | |
|---|---|---|---|---|
| 9,208,922 | B2 * | 12/2015 | Yoshida | H01R 13/6596 |
| 9,293,856 | B2 * | 3/2016 | Shigeta | H01R 13/5202 |
| 9,608,360 | B1 * | 3/2017 | Yang | H01R 13/5219 |
| 9,929,491 | B2 * | 3/2018 | Yamaguchi | H01R 11/12 |
| 9,954,304 | B2 * | 4/2018 | Wang | H01R 13/5202 |
| 9,966,715 | B2 * | 5/2018 | Ishibashi | H01R 13/512 |
| 10,074,926 | B2 * | 9/2018 | Rui | H01R 13/5205 |
| 10,116,093 | B2 * | 10/2018 | Ishibashi | H02K 5/225 |
| 2005/0162026 | A1 * | 7/2005 | McCain | H02K 5/10 310/88 |
| 2012/0142214 | A1 * | 6/2012 | Kawamura | H01R 11/12 439/571 |
| 2012/0270444 | A1 * | 10/2012 | Kawamura | H01R 13/5205 439/607.44 |
| 2014/0120767 | A1 * | 5/2014 | Itsuki | H01R 13/5202 439/587 |
| 2014/0287631 | A1 * | 9/2014 | Tashiro | H01R 43/20 439/733.1 |
| 2018/0019544 | A1 * | 1/2018 | Ishibashi | H01R 13/02 |
| 2018/0366864 | A1 * | 12/2018 | Motohashi | H01R 13/5208 |

FOREIGN PATENT DOCUMENTS

| | | | |
|---|---|---|---|
| JP | 2011-165328 | A | 8/2011 |
| WO | 2011/096590 | A1 | 8/2011 |

* cited by examiner

CONNECTOR

CROSS-REFERENCE TO RELATED APPLICATION(S)

The present application claims priority to and incorporates by reference the entire contents of Japanese Patent Application No. 2019-043287 filed in Japan on Mar. 11, 2019.

BACKGROUND OF THE INVENTION

1. Field of the Invention

The present invention relates to a connector.

2. Description of the Related Art

Conventionally, there is a connector having a packing. Japanese Patent Application Laid-open No. 2004-327169 discloses a technology of a connector having a packing provided between a first article and a second article to keep a space these articles watertight. The packing of Japanese Patent Application Laid-open No. 2004-327169 includes a protruding piece protruding from a position bisecting a thickness of a packing body and a fixed portion provided on the protruding piece and fixed to the first article. According to the packing of Japanese Patent Application Laid-open No. 2004-327169, the packing can be miniaturized, and the space between the articles can be surely waterproofed.

There is still room for improvement in suppressing displacement or detachment of the packing. For example, it is preferable that displacement or detachment of the packing in a case where a force acts on the packing can be more surely suppressed.

SUMMARY OF THE INVENTION

An object of the present invention is to provide a connector in which displacement of a packing or detachment of the packing can be suppressed.

In order to achieve the above mentioned object, a connector according to one aspect of the present invention includes a packing that includes a seal portion having an annular shape and a piece portion protruding from the seal portion and having a through-hole; and a fitting portion that holds a terminal, is mounted with the packing, and is fitted to a target to be fitted so that a space between the fitting portion and the target to be fitted is sealed by the packing, wherein the fitting portion includes: a first member that includes a cylindrical portion having an outer surface on which the seal portion is mounted; a second member that is attached to the cylindrical portion; a projection portion that is provided in one member of the first member and the second member, is inserted into the through-hole, and includes a tip projecting from the through-hole; and an opening portion that is provided in the other member of the first member and the second member and into which the tip is inserted.

According to another aspect of the present invention, in the connector, it is preferable that the through-hole is located closer to the target to be fitted than the seal portion is, in a direction in which the fitting portion and the target to be fitted are fitted to each other.

According to still another aspect of the present invention, in the connector, it is preferable that the piece portion includes a base portion that protrudes from the seal portion along the direction in which the fitting portion and the target to be fitted are fitted to each other and a tip portion that protrudes from the base portion toward a center of the seal portion, and the through-hole is formed in the tip portion.

According to still another aspect of the present invention, in the connector, it is preferable that the other member includes a second through-hole that penetrates the other member along the direction in which the fitting portion and the target to be fitted are fitted to each other, one end of the second through-hole being the opening portion, and the projection portion is inserted into the second through-hole.

According to still another aspect of the present invention, in the connector, it is preferable that the first member is a housing that holds the terminal, and the second member is a holder that is fitted to the cylindrical portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. Note that the present invention is not limited by this embodiment. In addition, components in the following embodiment include components that can be easily assumed by those skilled in the art or components that are substantially the same as each other.

Embodiment

Figure 1:
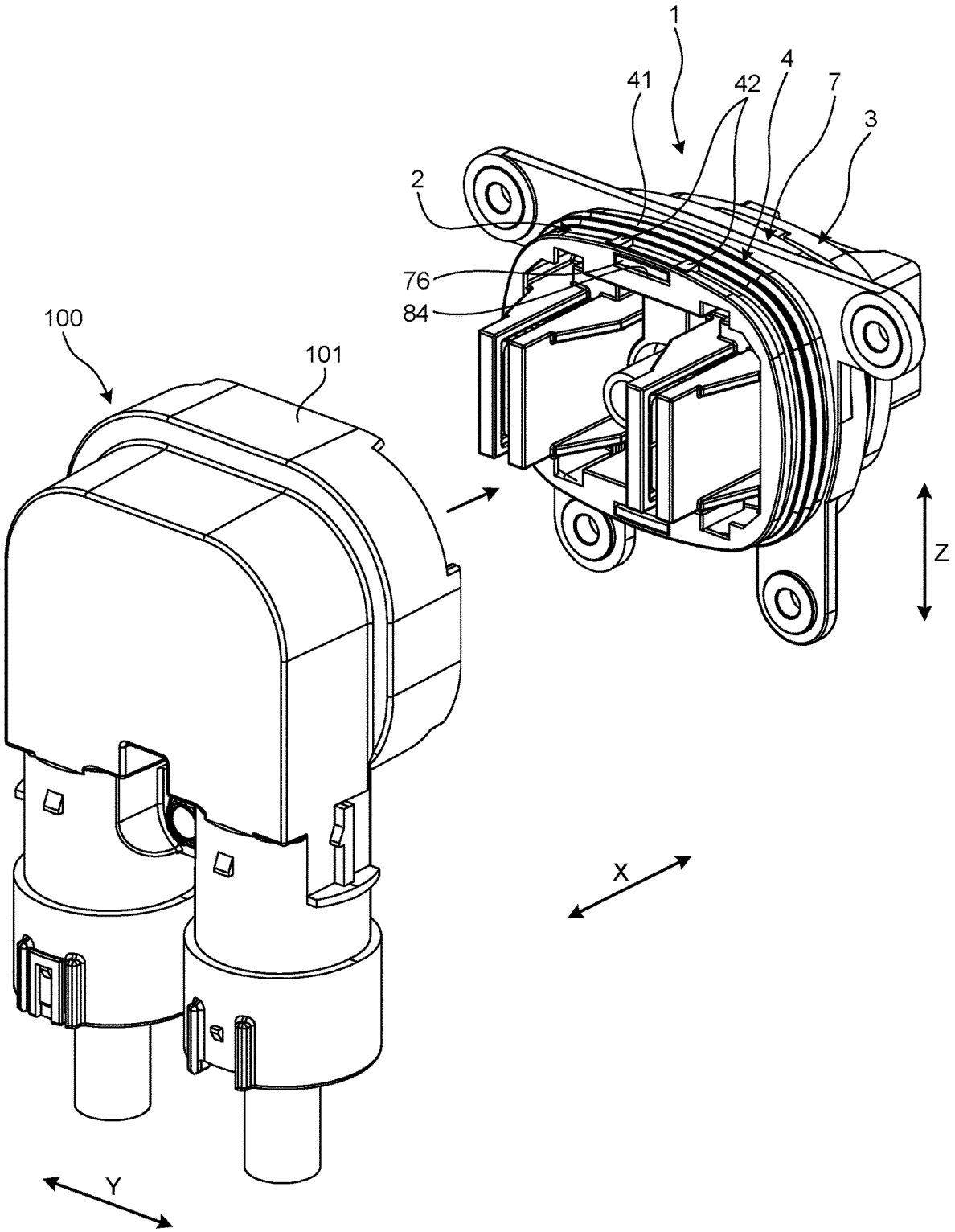
FIG. 1 is a perspective view of a connector and a male connector according to an embodiment.
Figure 3:
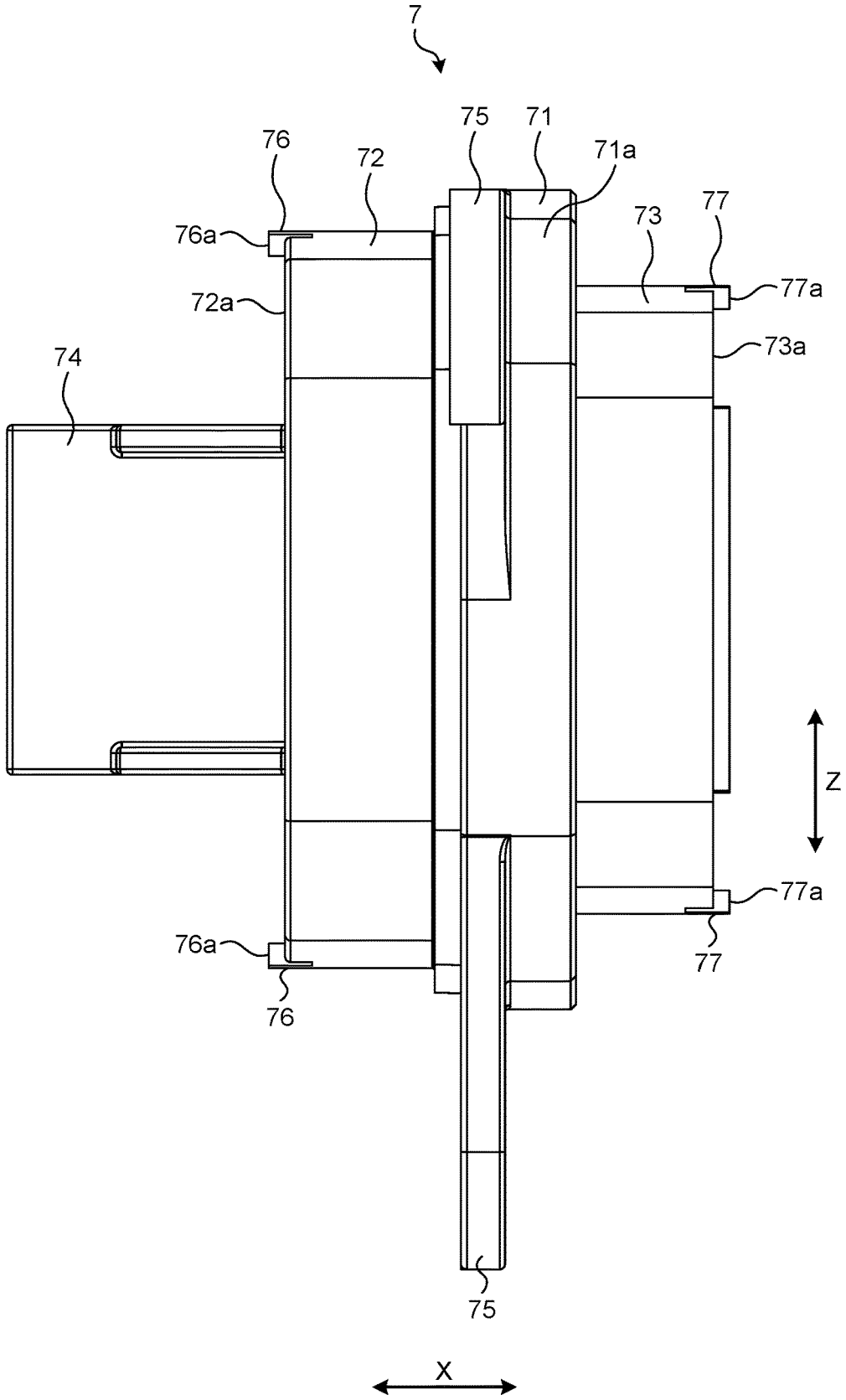
FIG. 3 is a side view of a housing according to the embodiment.
Figure 4:
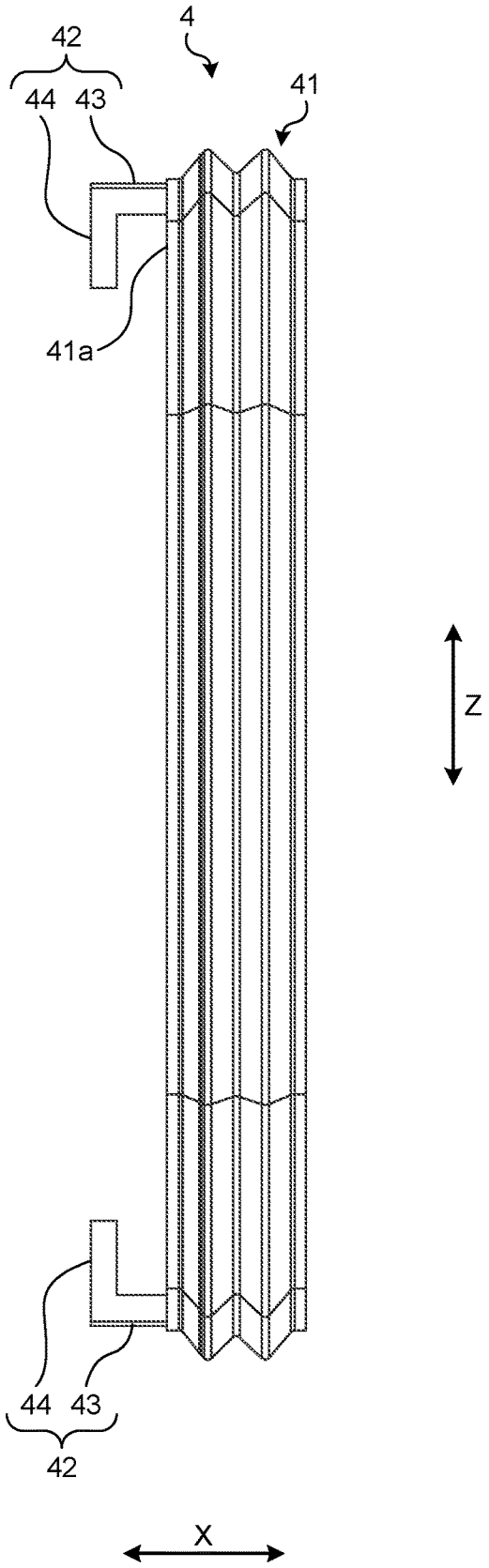
FIG. 4 is a side view of a first packing according to the embodiment.
Figure 5:
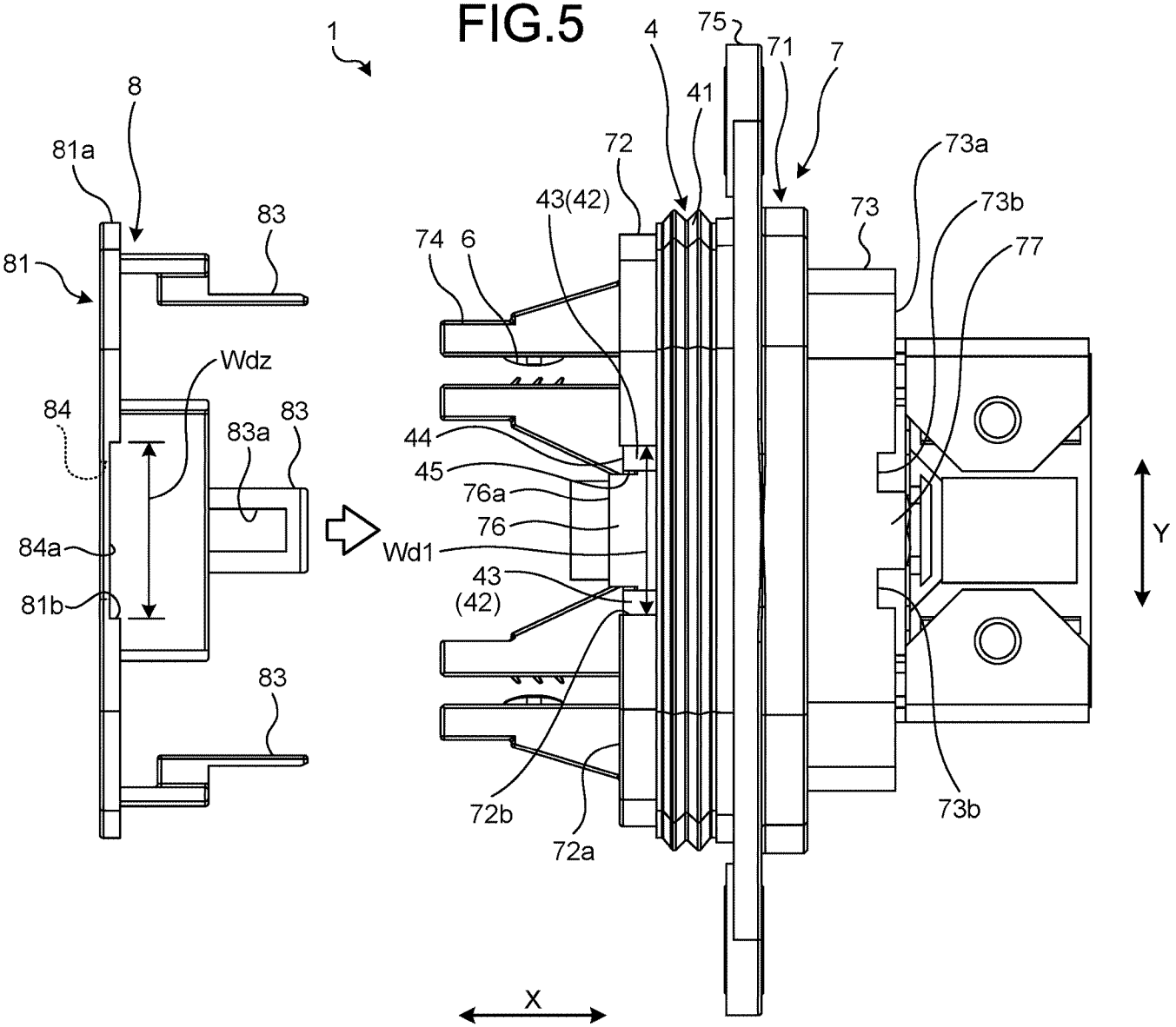
FIG. 5 is a view for describing a procedure for assembling the first packing in the embodiment.
Figure 6:
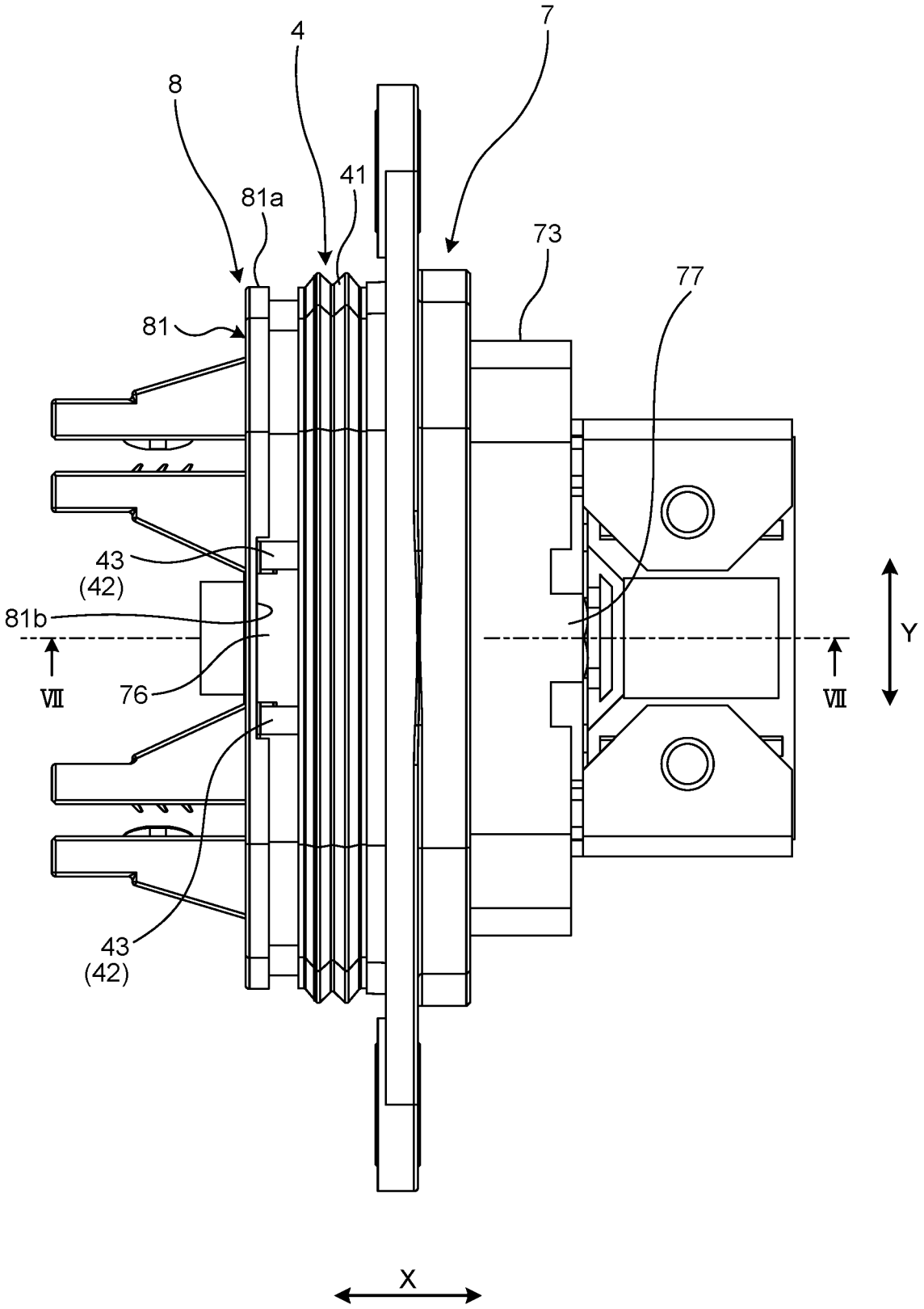
FIG. 6 is a plan view of the connector in which the first packing and a front holder are assembled.
Figure 7:
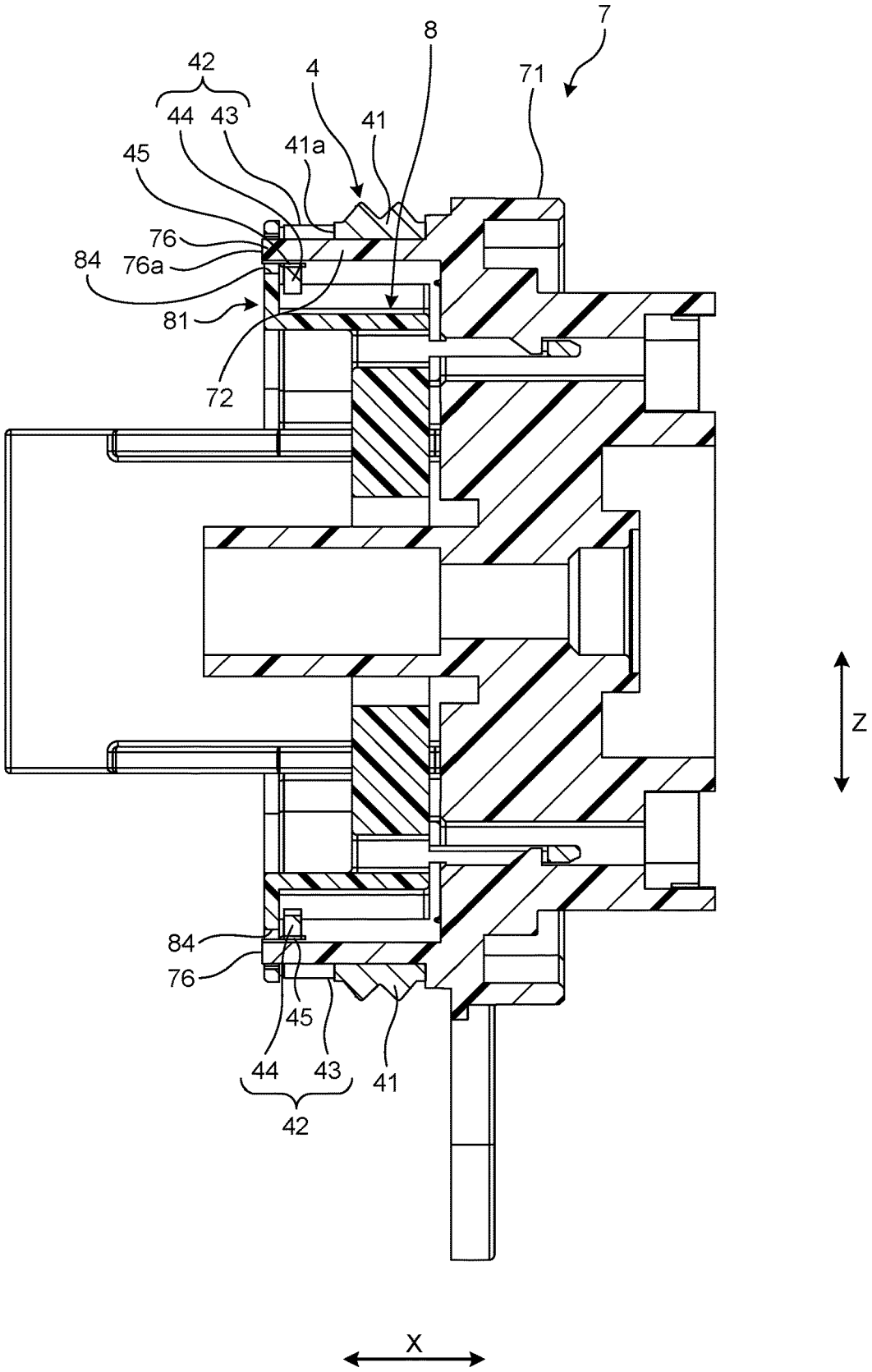
FIG. 7 is a cross-sectional view of the connector in which the first packing and the front holder are assembled.
Figure 8:
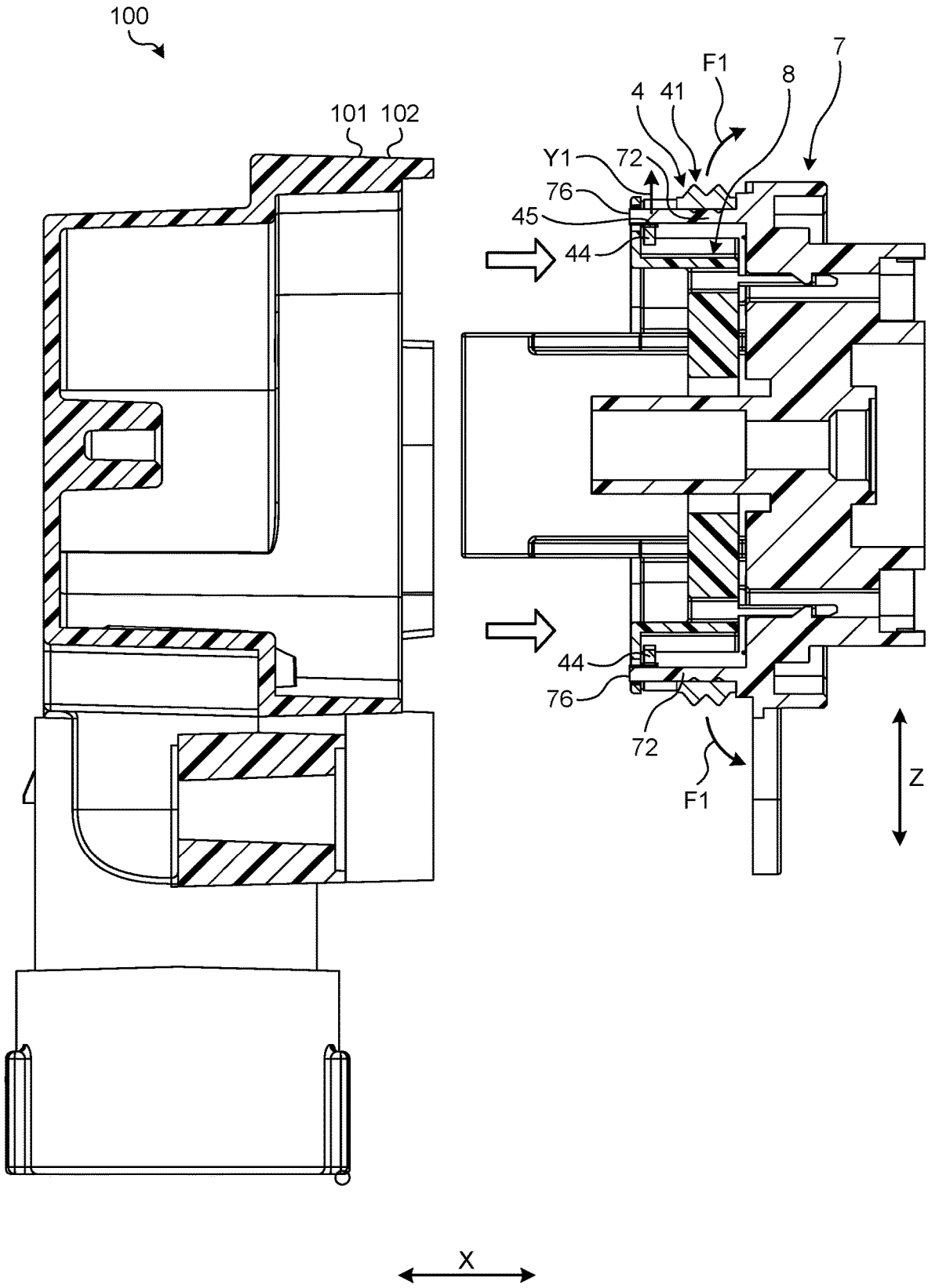
FIG. 8 is a view for describing fitting of the male connector to the connector of the embodiment.

An embodiment will be described with reference to FIGS. 1 to 8. The present embodiment relates to a connector. FIG. 1 is a perspective view of a connector and a male connector according to an embodiment, FIG. 2 is an exploded perspective view of the connector according to the embodiment, FIG. 3 is a side view of a housing according to the embodiment, FIG. 4 is a side view of a first packing according to the embodiment, FIG. 5 is a view for describing a procedure for assembling the first packing in the embodiment, FIG. 6 is a plan view of the connector in which the first packing and a front holder are assembled, FIG. 7 is a cross-sectional view of the connector in which the first packing and the front holder are assembled, and FIG. 8 is a view for describing fitting of the male connector to the connector of the embodiment.

As illustrated in FIG. 1, a connector 1 according to the present embodiment is a female connector having female terminals 6. The connector 1 is fitted to a male connector 100 that is a target to be fitted. The female terminals 6 are electrically connected to male terminals of the male connector 100 by fitting the connector 1 to the male connector 100. In the present specification, a direction in which the connector 1 and the male connector 100 are fitted to each other is referred to as a "first direction X".

Figure 2:
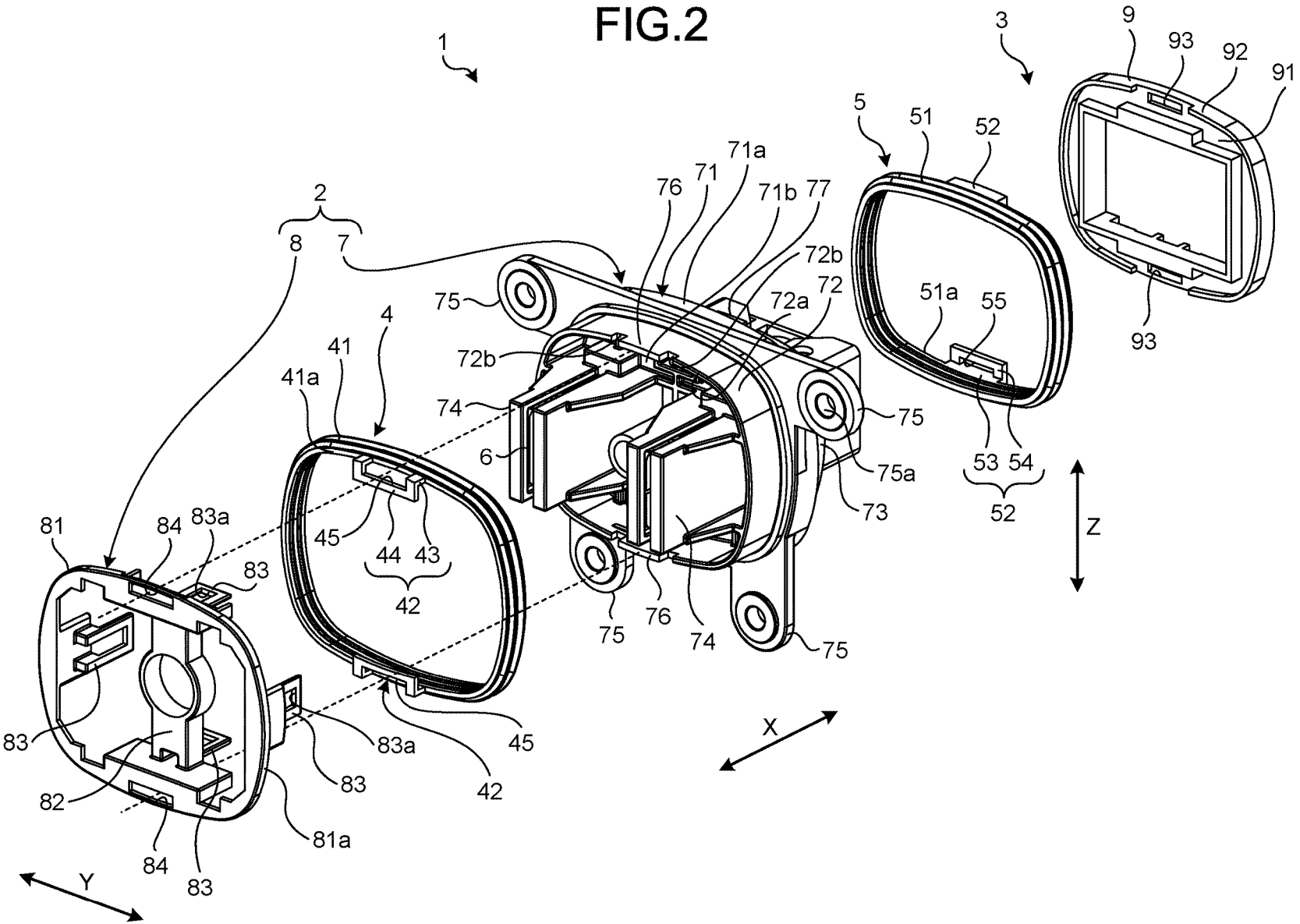
FIG. 2 is an exploded perspective view of the connector according to the embodiment.

As illustrated in FIGS. 1 and 2, the connector 1 includes a first fitting portion 2, a second fitting portion 3, a first packing 4, a second packing 5, and the female terminals 6. The first fitting portion 2 is a fitting portion that is fitted to a housing 101 of the male connector 100. The second fitting portion 3 is a fitting portion that is fitted to a housing of a device such as an inverter. In the following description, a target device to which the connector 1 is to be fixed is simply referred to as "a fixing target device". The connector 1 of the present embodiment is fitted to a case of the fixing target device and is fixed to the case. The male connector 100 is connected to the connector 1 fixed to the fixing target device. The male connector 100 is connected to, for example, a power supply. In this case, power output from the power supply is supplied to the fixing target device through the male connector 100 and the connector 1.

As illustrated in FIGS. 1 and 2, the first fitting portion 2 includes a housing 7 and a front holder 8. The housing 7 and the front holder 8 are molded from, for example, an insulating synthetic resin. The housing 7 includes a body portion 71, a first cylindrical portion 72, a second cylindrical portion 73, terminal covers 74, and attaching portions 75. The body portion 71 includes a cylindrical outer shell portion 71*a* and a wall portion 71*b*. An axial direction of the outer shell portion 71*a* matches the first direction X. The wall portion 71*b* is formed integrally with the outer shell portion 71*a*. The wall portion 71*b* is a partition wall-like component that partitions an internal space of the outer shell portion 71*a*.

The first cylindrical portion 72 is a cylindrical component. The first cylindrical portion 72 protrudes from the body portion 71 along the first direction X. A cross-sectional shape of the first cylindrical portion 72 is a substantially rectangular shape. More specifically, the cross-sectional shape of the first cylindrical portion 72 is a shape in which each side of a rectangle is curved outward and four corners of the rectangle are formed in an arc shape.

The first cylindrical portion 72 includes projection portions 76. The projection portion 76 is a convex component provided at an edge portion 72*a* of a tip of the first cylindrical portion 72. The projection portion 76 protrudes along the first direction X as compared with an adjacent portion in the edge portion 72*a*. The first cylindrical portion 72 of the present embodiment includes two projection portions 76. The projection portions 76 are arranged on long side portions of the first cylindrical portion 72. More specifically, the projection portions 76 are arranged at central portions of the long side portions of the first cylindrical portion 72.

In the following description, a long side direction of the first cylindrical portion 72 is referred to as a "second direction Y", and a short side direction of the first cylindrical portion 72 is referred to as a "third direction Z". The second direction Y and the third direction Z are orthogonal to each other, and are each orthogonal to the first direction X. A long side direction of a second cylindrical portion 73 to be described later is the second direction Y, and a short side direction of the second cylindrical portion 73 is the third direction Z.

The two projection portions 76 face each other in the third direction Z. The edge portion 72*a* is provided with notches 72*b* adjacent to both sides of the projection portion 76. As illustrated in FIG. 3, a tip 76*a* of the projection portion 76 protrudes further than a portion other than the projection portion 76 in the edge portion 72*a* along the first direction X. A shape of the projection portion 76 of the present embodiment is a plate shape. A cross-sectional shape of the projection portion 76 in a cross section orthogonal to the first direction X is a substantially rectangular shape, and is slightly curved outward in the third direction Z. The tip 76*a* of the projection portion 76 is flat.

The second cylindrical portion 73 is a cylindrical component. The second cylindrical portion 73 protrudes from the body portion 71 along the first direction X. A protruding direction of the second cylindrical portion 73 is opposite to a protruding direction of the first cylindrical portion 72. A cross-sectional shape of the second cylindrical portion 73 is similar to a cross-sectional shape of the first cylindrical portion 72.

The second cylindrical portion 73 includes projection portions 77. The projection portion 77 is a convex component provided at an edge portion 73*a* of a tip of the second cylindrical portion 73. The second cylindrical portion 73 includes two projection portions 77. The projection portions 77 are arranged on long sides of the second cylindrical portion 73. More specifically, the projection portions 77 are arranged at central portions of the long sides of the second cylindrical portion 73.

The two projection portions 77 face each other in the third direction Z. The edge portion 73*a* is provided with notches 73*b* (see FIG. 5) on both sides of the projection portion 77. As illustrated in FIG. 3, a tip 77*a* of the projection portion 77 protrudes further than a portion other than the projection portion 77 in the edge portion 73*a* along the first direction X.

The terminal cover 74 protrudes from the wall portion 71*b* of the body portion 71 along the first direction X. A protruding direction of the terminal cover 74 is the same as that of the first cylindrical portion 72. The terminal cover 74 covers the female terminal 6 to prevent a worker's finger or a tool from erroneously coming into contact with the female terminal 6. The connector 1 of the present embodiment includes two terminal covers 74. The two terminal covers 74 are arranged along the second direction Y.

The attaching portion 75 is a portion fixed to the fixing target device. The attaching portion 75 protrudes from the outer shell portion 71*a* in a direction orthogonal to the first direction X. The housing 7 of the present embodiment includes four attaching portions 75. The attaching portions 75 are arranged at four corners of the outer shell portion 71*a*, respectively. The attaching portion 75 includes a hole 75*a* into which a fastening member such as a screw is inserted. The attaching portion 75 is fixed to the housing of the fixing target device by the fastening member inserted into the hole 75*a*.

The front holder 8 is a member attached to the first cylindrical portion 72 of the housing 7. As illustrated in FIG. 2, the front holder 8 includes a body portion 81, a columnar portion 82, and engaging portions 83. The body portion 81, the columnar portion 82, and the engaging portions 83 are formed integrally with one another. The body portion 81 is an annular component. A shape of the body portion 81 when viewed from the first direction X corresponds to the cross-sectional shape of the first cylindrical portion 72. A shape of an outer edge of the body portion 81 is a shape in which each side of a rectangle is curved outward and four corners of the rectangle are formed in an arc shape. An outer edge portion of the body portion 81 abuts the edge portion 72*a* of the first cylindrical portion 72.

The body portion 81 includes a cylindrical portion 81*a* fitted to the first cylindrical portion 72. The cylindrical portion 81*a* is arranged at the outer edge portion of the body portion 81, and protrudes along the first direction X. A cross-sectional shape of the cylindrical portion 81*a* corresponds to that of the first cylindrical portion 72. The cylindrical portion 81*a* is fitted to the first cylindrical portion 72 so that an outer peripheral surface of the cylindrical portion 81*a* and an inner peripheral surface of the first cylindrical portion 72 face each other. The columnar portion 82 is a rod-shaped or plate-shaped component extending along the third direction Z. The columnar portion 82 connects long sides of the body portion 81 to each other.

The engaging portion 83 fixes the front holder 8 to the housing 7 by engaging with an engaging portion provided in the housing 7. The engaging portion 83 protrudes from a facing surface of the body portion 81 along the first direction X. The facing surface of the body portion 81 is a surface facing the edge portion 72*a* of the first cylindrical portion 72. The engaging portions 83 are arranged on long side portions and short side portions of the body portion 81, respectively. The engaging portion 83 includes a hole 83*a*. The hole 83*a* engages with a projection provided on an inner surface of the housing 7, and is locked by the projection.

The body portion 81 includes two second through-holes 84. The second through-holes 84 are arranged on long side portions of the body portion 81, respectively. The second through-holes 84 penetrates the body portion 81 along the first direction X. The second through-holes 84 are arranged at positions corresponding to the projection portions 76 of the housing 7. A shape of the second through-hole 84 when viewed from the first direction X is a substantially rectangular shape in which the second direction Y is a longitudinal direction. A width of the second through-hole 84 in the second direction Y and a width of the second through-hole 84 in the third direction Z are slightly larger than a width and a thickness of the projection portion 76, respectively. That is, the second through-hole 84 is formed so that there is a slight gap between the second through-hole 84 and the projection portion 76 when the projection portion 76 is inserted into the second through-hole 84.

The first packing 4 is a waterproof member formed of a resin such as rubber. The first packing 4 includes a seal portion 41 and piece portions 42. The seal portion 41 and the piece portions 42 are formed integrally with each other. The seal portion 41 is formed in an annular shape, and is mounted on an outer surface of the first cylindrical portion 72. A shape of the seal portion 41 when viewed from the first direction X corresponds to the cross-sectional shape of the first cylindrical portion 72. The seal portion 41 seals a space between the housing 101 of the male connector 100 and the first cylindrical portion 72.

The piece portion 42 protrudes from the seal portion 41, and includes a through-hole 45. The first packing 4 of the present embodiment includes two piece portions 42. The piece portions 42 are arranged on long side portions of the seal portion 41, respectively. More specifically, the piece portions 42 are arranged at central portions of the long side portions of the seal portion 41. The two piece portions 42 face each other in the third direction Z.

The piece portion 42 includes a base portion 43 and a tip portion 44. The base portion 43 protrudes from the seal portion 41 along the first direction X. The base portion 43 is formed in a plate shape. A protruding direction of the base portion 43 is a direction toward the male connector 100 that is the target to be fitted. The base portion 43 protrudes from a first side surface 41*a* of the seal portion 41. The first side surface 41*a* is a side surface facing the male connector 100, of two side surfaces of the seal portion 41. In other words, the first side surface 41*a* is a side surface facing the body portion 81 of the front holder 8, of the two side surfaces of the seal portion 41.

The tip portion 44 protrudes from a tip of the base portion 43 toward the center of the seal portion 41 along the third direction Z. In other words, the tip portion 44 protrudes from the base portion 43 toward a space portion surrounded by the seal portion 41. The tip portion 44 is formed in a plate shape. The tip portion 44 of the present embodiment protrudes in a direction orthogonal to the base portion 43. Therefore, two tip portions 44 protrude so that tip surfaces of the tip portions 44 face each other in the third direction Z.

The through-hole 45 penetrates the piece portion 42. The through-hole 45 of the present embodiment penetrates the base portion 43 and the tip portion 44. That is, the through-hole 45 continuous from the base portion 43 to the tip portion 44 is formed in the piece portion 42. A shape of a portion of the through-hole 45 formed at the tip portion 44 corresponds to the cross-sectional shape of the projection portion 76. A shape of the through-hole 45 when viewed from the first direction X is a substantially rectangular shape in which the second direction Y is a longitudinal direction. The through-hole 45 is formed so that there is a slight gap between the through-hole 45 and the projection portion 76 when the projection portion 76 is inserted into the through-hole 45.

A rear holder 9 is a member attached to the second cylindrical portion 73 of the housing 7. The rear holder 9 is molded from, for example, an insulating synthetic resin. The second fitting portion 3 includes the housing 7 and the rear holder 9. As illustrated in FIG. 2, the rear holder 9 includes a body portion 91 and a cylindrical portion 92. The body portion 91 and the cylindrical portion 92 are formed integrally with each other. The body portion 91 is an annular component. A shape of the body portion 91 when viewed from the first direction X corresponds to the cross-sectional shape of the second cylindrical portion 73. A shape of an outer edge of the body portion 91 is a shape in which each side of a rectangle is curved outward and four corners of the rectangle are formed in an arc shape. The body portion 91 abuts the edge portion 73*a* of the second cylindrical portion 73.

The cylindrical portion 92 protrudes from an outer edge portion of the body portion 91 along the first direction X. The cylindrical portion 92 is a cylindrical component, and is fitted to the second cylindrical portion 73 of the housing 7. A cross-sectional shape of the cylindrical portion 92 corresponds to that of the second cylindrical portion 73. The cylindrical portion 92 is fitted to the second cylindrical portion 73 so that an inner peripheral surface of the cylindrical portion 92 and an outer peripheral surface of the second cylindrical portion 73 face each other. That is, the cylindrical portion 92 covers a tip portion of the second cylindrical portion 73 from outside.

The body portion 91 includes two second through-holes 93. The second through-holes 93 are arranged on long side portions of the body portion 91, respectively. The second through-holes 93 penetrate the body portion 91 along the first direction X. The second through-holes 93 are arranged at positions corresponding to the projection portions 77 of the housing 7. A shape of the second through-hole 93 when viewed from the first direction X is a substantially rectangular shape in which the second direction Y is a longitudinal direction. A width of the second through-hole 93 in the second direction Y and a width of the second through-hole 93 in the third direction Z are slightly larger than a width and a thickness of the projection portion 77, respectively. That is, the second through-hole 93 is formed so that there is a slight gap between the second through-hole 93 and the projection portion 77 when the projection portion 77 is inserted into the second through-hole 93.

The second packing 5 is a waterproof member formed of a resin such as rubber. The second packing 5 includes a seal portion 51 and piece portions 52. The seal portion 51 and the piece portions 52 are formed integrally with each other. The seal portion 51 is formed in an annular shape, and is mounted on an outer surface of the second cylindrical portion 73. A shape of the seal portion 51 when viewed from the first direction X corresponds to the cross-sectional shape of the second cylindrical portion 73. The seal portion 51 seals a space between the housing of the fixing target device and the second cylindrical portion 73.

The piece portion 52 protrudes from the seal portion 51, and includes a through-hole 55. The second packing 5 of the present embodiment includes two piece portions 52. The piece portions 52 are arranged on long side portions of the seal portion 51, respectively. More specifically, the piece portions 52 are arranged at central portions of the long side portions of the seal portion 51. The two piece portions 52 face each other in the third direction Z.

The piece portion 52 includes a base portion 53 and a tip portion 54. The base portion 53 protrudes from the seal portion 51 along the first direction X. A protruding direction of the base portion 53 is a direction toward the case of the fitting target device. The base portion 53 protrudes from a first side surface 51*a* of the seal portion 51. The first side surface 51*a* is a side surface facing the case of the fitting target device, of two side surfaces of the seal portion 51. In other words, the first side surface 51*a* is a side surface facing the body portion 91 of the rear holder 9, of the two side surfaces of the seal portion 51.

The tip portion 54 protrudes from a tip of the base portion 53 toward the center of the seal portion 51 along the third direction Z. In other words, the tip portion 54 protrudes from the base portion 53 toward a space portion surrounded by the seal portion 51. The tip portion 54 of the present embodiment protrudes in a direction orthogonal to the base portion 53. Therefore, two tip portions 54 protrude so that tip surfaces of the tip portions 54 face each other in the third direction Z.

The through-hole 55 penetrates the piece portion 52. The through-hole 55 of the present embodiment penetrates the tip portion 54. A shape of the through-hole 55 corresponds to the cross-sectional shape of the projection portion 77. A shape of the through-hole 55 when viewed from the first direction X is a substantially rectangular shape in which the second direction Y is a longitudinal direction. The through-hole 55 is formed so that there is a slight gap between the through-hole 55 and the projection portion 77 when the projection portion 77 is inserted into the through-hole 55.

A procedure for assembling the first packing 4 in the embodiment will be described with reference to FIGS. 5 and 6. First, the first packing 4 is attached to the housing 7, as illustrated in FIG. 5. The seal portion 41 of the first packing 4 is mounted on an outer peripheral surface of the first cylindrical portion 72. The first packing 4 is mounted on the first cylindrical portion 72 in a posture where the piece portion 42 is directed to an opposite side to the body portion 71 of the housing 7. Therefore, in the first packing 4 mounted on the first cylindrical portion 72, the piece portion 42 protrudes from the seal portion 41 toward a tip side of the first cylindrical portion 72.

The projection portion 76 of the first cylindrical portion 72 is inserted into the through-hole 45 of the piece portion 42, and protrudes from the through-hole 45 along the first direction X. When viewed from the body portion 71, the tip 76*a* of the projection portion 76 is located farther in the first direction X than the piece portion 42. The tip portion 44 of the piece portion 42 enters the notch 72*b* of the first cylindrical portion 72, and is accommodated in the notch 72*b*. A depth of the notch 72*b* is greater than a thickness of the tip portion 44. Therefore, it is difficult for the piece portion 42 to interfere with other members, and damage to the piece portion 42 is thus suppressed.

In the second direction Y, a slight gap may be generated between the projection portion 76 and the piece portion 42. A size of the gap is, for example, a degree generated by a dimensional tolerance of the projection portion 76 or the through-hole 45. Therefore, the projection portion 76 can accurately position the first packing 4 in the second direction Y. In addition, in a case where the first packing 4 attempts to rotate relatively with respect to the first cylindrical portion 72, the projection portion 76 and the notch 72*b* lock the piece portion 42. Therefore, the projection portion 76 and the notch 72*b* can restrict the relative rotation of the first packing 4 with respect to the first cylindrical portion 72.

After the first packing 4 is mounted on the first cylindrical portion 72, the front holder 8 is attached to the housing 7. The front holder 8 is attached to the housing 7 in a posture where the engaging portion 83 is directed to the housing 7. When the front holder 8 is inserted deeply into the first cylindrical portion 72, the engaging portion 83 of the front holder 8 is locked by the housing 7. Thus, the front holder 8 is fixed to the housing 7. In addition, when the front holder 8 is inserted into the first cylindrical portion 72, the projection portion 76 of the first cylindrical portion 72 is inserted into the second through-hole 84 of the front holder 8.

As illustrated in FIG. 5, the second through-hole 84 has an opening portion 84*a*. The opening portion 84*a* is an opening portion opened toward a protruding direction of the cylindrical portion 81*a*, of two opening portions of the second through-hole 84. The projection portion 76 is inserted from the opening portion 84*a* into the second through-hole 84. In a state where the front holder 8 is fixed to the housing 7, the tip 76*a* of the projection portion 76 may be located inside the second through-hole 84, or may protrude from the second through-hole 84. The connector 1 of the present embodiment is configured so that the tip 76*a* of the projection portion 76 protrudes from the second through-hole 84.

The second through-hole 84 holds a portion of the projection portion 76 inserted into the second through-hole 84. A size of the gap between the second through-hole 84 and the projection portion 76 is determined so that the piece portion 42 of the first packing 4 cannot pass through this gap. Therefore, the projection portion 76 is inserted into the second through-hole 84 to restrict the piece portion 42 from being detached from the projection portion 76.

As illustrated in FIG. 5, the cylindrical portion 81*a* of the front holder 8 includes a notch 81*b*. The notch 81*b* is formed at a position corresponding to the piece portion 42 in the cylindrical portion 81*a*. In the second direction Y, a width Wdz of the notch 81*b* is slightly larger than a width Wd1 of the piece portion 42. A protruding height of the cylindrical portion 81*a* is substantially zero at a portion of the notch 81*b*. That is, the cylindrical portion 81*a* is divided into two parts by the notch 81*b*.

As illustrated in FIG. 6, when the front holder 8 is fixed to the housing 7, a part of the piece portion 42 is accommodated in the notch 81*b*. The notch 81*b* faces a side surface of the piece portion 42 in the second direction Y. The body portion 81 of the front holder 8 covers the piece portion 42, and protects the piece portion 42. For example, when the connector 1 is fitted to the male connector 100, the body portion 81 protects the piece portion 42 so that the piece portion 42 does not interfere with the male connector 100.

FIG. 7 illustrates a cross section taken along line VII-VII of FIG. 6. The projection portion 76 of the housing 7 is inserted through the through-hole 45 of the first packing 4, and is further inserted through the second through-hole 84 of the front holder 8. The tip 76*a* of the projection portion 76 protrudes from the through-hole 45, such that a hooking margin of the projection portion 76 to the piece portion 42 is increased. Therefore, it is difficult for the piece portion 42 to be detached from the projection portion 76. Further, the projection portion 76 is inserted into the opening portion 84*a* of the second through-hole 84, such that the detachment of the piece portion 42 from the projection portion 76 is effectively suppressed.

In addition, the body portion 81 of the front holder 8 is close to the piece portion 42 in the first direction X. More specifically, the body portion 81 is located in the vicinity of the tip portion 44 of the piece portion 42 in the first direction X, and faces the tip portion 44. Therefore, the body portion 81 restricts the first packing 4 from being moved relatively with respect to the first cylindrical portion 72 in the first direction X. The body portion 81 restricts displacement of the first packing 4 to suppress deterioration of water cut-off performance of the first packing 4.

In addition, the housing 7 and the front holder 8 can suppress turn-up or floating of the first packing 4, as described below. FIG. 8 illustrates the male connector 100 fitted to the connector 1. The housing 101 of the male connector 100 is fitted to the connector 1 while relatively moving along the first direction X with respect to the connector 1. The housing 101 includes a cylindrical portion 102 fitted to the first cylindrical portion 72 of the connector 1. A cross-sectional shape of the cylindrical portion 102 corresponds to that of the first cylindrical portion 72. The cylindrical portion 102 is fitted to the first cylindrical portion 72 while accommodating the first cylindrical portion 72 therein. The seal portion 41 of the first packing 4 is sandwiched between the outer surface of the first cylindrical portion 72 and an inner surface of the cylindrical portion 102 to seal a space between the outer surface of the first cylindrical portion 72 and the inner surface of the cylindrical portion 102.

When the cylindrical portion 102 is fitted to the first cylindrical portion 72, a force F1 illustrated in FIG. 8 acts on the seal portion 41. The force F1 is a force in a direction in which the seal portion 41 is separated from the outer surface of the first cylindrical portion 72. In a case where the force F1 acts on the seal portion 41, the projection portion 76 locks the tip portion 44 of the first packing 4 to suppress floating or turn-up of the seal portion 41. The piece portion 42 of the present embodiment protrudes from the seal portion 41 toward the male connector 100 in the first direction X. Therefore, when the force F1 acts, the piece portion 42 attempts to move in a direction indicated by an arrow Y1. The projection portion 76 restricts the movement of the piece portion 42 toward the arrow Y1, and resultantly suppresses the floating or the turn-up of the seal portion 41.

As described above, in the connector 1 of the present embodiment, the relative rotation of the first packing 4 with respect to the first cylindrical portion 72, and the floating or the turn-up of the seal portion 41 are suppressed. Therefore, in the connector 1 of the present embodiment, it is possible to suppress the deterioration of the water cut-off performance of the first packing 4.

A procedure for assembling the second packing 5 is similar to the procedure for assembling the first packing 4. That is, the second packing 5 is attached to the second cylindrical portion 73 of the housing 7, and the rear holder 9 is then attached to the second cylindrical portion 73. As illustrated in FIG. 2, the seal portion 51 of the second packing 5 is mounted on the second cylindrical portion 73 in a posture where the piece portion 52 is directed to an opposite side to the body portion 71 of the housing 7. In this case, the projection portion 77 of the second cylindrical portion 73 is inserted into the through-hole 55 of the piece portion 52.

When the rear holder 9 is attached to the second cylindrical portion 73, the projection portion 77 is inserted into the second through-hole 93 of the rear holder 9. The rear holder 9 may be fixed directly to the housing 7 or may be fixed to the housing 7 through another member. The projection portion 77 and the rear holder 9 can restrict relative rotation of the second packing 5 with respect to the second cylindrical portion 73, and can suppress floating and turn-up of the seal portion 51.

As described above, the connector 1 according to the present embodiment includes the packing (the first packing 4 and the second packing 5) and the fitting portion (the first fitting portion 2 and the second fitting portion 3). An example of a water cut-off structure by a combination of the first packing 4 and the first fitting portion 2 will be described in detail. The first packing 4 includes the seal portion 41 having the annular shape and the piece portion 42 protruding from the seal portion 41 and including the through-hole 45. The first fitting portion 2 holds the female terminals 6 therein, and is mounted with the first packing 4. The first fitting portion 2 is fitted to the male connector 100 so that a space between the first fitting portion 2 and the male connector 100 is sealed by the first packing 4.

The first fitting portion 2 includes the housing 7 as a first member, the front holder 8 as a second member, the projection portions 76, and the opening portions 84*a*. The housing 7 includes the first cylindrical portion 72, and the seal portion 41 is mounted on the outer surface of the first cylindrical portion 72. The front holder 8 is a member attached to the first cylindrical portion 72. The projection portion 76 is provided in the housing 7, is inserted into the through-hole 45, and includes the tip 76*a* protruding from the through-hole 45. The opening portion 84*a* is provided in the front holder 8, and the tip 76*a* of the projection portion 76 is inserted into the opening portion 84*a*.

According to the configuration of the connector 1 described above, the tip 76*a* of the projection portion 76 protrudes from the through-hole 45 and is inserted into the opening portion 84*a*, such that the detachment of the piece portion 42 of the projection portion 76 is suppressed. Therefore, detachment of the first packing 4 from the first cylindrical portion 72 is suppressed. In addition, the projection portion 76 is inserted into the through-hole 45, such that displacement of the first packing 4 with respect to the first cylindrical portion 72 is suppressed. For example, the relative rotation of the first packing 4 with respect to the first cylindrical portion 72 is restricted.

In the connector 1 of the present embodiment, the through-hole 45 is located closer to the male connector 100 than the seal portion 41 is, in the first direction X in which the first fitting portion 2 and the male connector 100 are fitted to each other. Therefore, the turn-up or detachment of the seal portion 41 when the first fitting portion 2 and the male connector 100 are fitted to each other is suitably suppressed.

The piece portion 42 of the present embodiment includes the base portion 43 and the tip portion 44. The base portion 43 protrudes from the seal portion 41 along the first direction X. The tip portion 44 protrudes from the base portion 43 toward the center side of the seal portion 41. The through-hole 45 is formed in the tip portion 44. Therefore, the projection portion 76 can support the piece portion 42 to restrict the turn-up or the detachment of the seal portion 41, in a case where a force in a direction orthogonal to the first direction X acts on the first packing 4.

The front holder 8 of the present embodiment includes the second through-holes 84. The second through-hole 84 penetrates the front holder 8 along the first direction X, and one end of the second through-hole 84 is the opening portion 84*a*. Side surfaces of the projection portion 76 are covered with the second through-hole 84, such that detachment of the first packing 4 from the projection portion 76 is suitably suppressed. In addition, the projection portion 76 inserted from the opening portion 84*a* can protrude from an opening portion on an opposite side of the second through-hole 84. In this case, detachment of the first packing 4 from the projection portion 76 is more surely suppressed.

Modification of Embodiment

A modification of the embodiment will be described. In the above embodiment, in the first packing 4, the piece portion 42 is provided on the long side portion of the seal portion 41. However, in addition to or instead of this, the piece portion 42 may be provided on a short side portion of the seal portion 41. The piece portion 42 is arranged, for example, at the center of the short side portion. The same applies to the second packing 5, and the piece portion 52 may be provided on a short side portion of the seal portion 51.

In the front holder 8, a portion into which the projection portion 76 is inserted may not penetrate the front holder 8. That is, the portion into which the projection portion 76 is inserted may be a recess portion instead of the second through-hole 84. One end of the recess portion is opened toward the housing 7 in the opening portion 84*a*. The other end of the recess portion is closed or is narrowed so that the projection portion 76 cannot pass therethrough. The same applies to the rear holder 9, and a recess portion into which the projection portion 77 is inserted may be provided instead of the second through-hole 93.

The shapes of the projection portions 76 and 77 are not limited to the illustrated shapes. The shapes of the projection portions 76 and 77 may be, for example, rod shapes or cylindrical shapes. The cross-sectional shapes of the projection portions 76 and 77 in a case where the shapes of the projection portions 76 and 77 are the rod shapes may be polygonal shapes or circular shapes. It is preferable that shapes of the opening portions provided in the front holder 8 or the rear holder 9 are shapes corresponding to the cross-sectional shapes of the projection portions 76 and 77. For example, in a case where the cross-sectional shape of the projection portion 76 is a circular shape, it is preferable that the shape of the opening portion 84*a* is a circular shape.

The projection portion 76 may be provided with a lock structure. For example, the front holder 8 may be provided with an engagement protrusion, and the projection portion 76 may be provided with an engagement recess portion engaging with the engagement protrusion. Conversely, the projection portion 76 may be provided with an engagement projection, and the front holder 8 may be provided with an engagement recess portion. The projection portion 76 is provided with the lock structure, such that components can be simplified. For example, in the front holder 8, the engaging portions 83 can be omitted.

Shapes or arrangements of the piece portions 42 and 52 are not limited to the exemplified shapes or arrangements. For example, protruding directions of the piece portions 42 and 52 may be opposite to the illustrated directions. That is, the piece portions 42 and 52 may protrude from the seal portions 41 and 51 toward the body portion 71 of the housing 7, respectively.

The seal portion 41 of the first packing 4 may be mounted on the front holder 8, instead of being mounted on the first cylindrical portion 72. In this case, the front holder 8 is provided with a cylindrical portion on which the seal portion 41 can be mounted. The first packing 4 may be fixed to the front holder 8 in advance. As an example, the first packing 4 may be formed on the front holder 8 by two-color molding. The seal portion 51 of the second packing 5 may be mounted on the rear holder 9, instead of being mounted on the second cylindrical portion 73. In this case, the rear holder 9 is provided with a cylindrical portion on which the seal portion 51 can be mounted. The second packing 5 may be fixed to the rear holder 9 in advance by two-color molding or the like.

Contrary to the above embodiment, the front holder 8 may be provided with a projection portion, and the housing 7 may be provided with an opening portion. In this case, the projection portion of the front holder 8 is inserted into the through-hole 45 of the first packing 4, and a tip of the projection portion is inserted into the opening portion of the housing 7. The opening portion of the housing 7 may be one end of a recess portion extending along the first direction X or may be one end of a through-hole penetrating the housing 7 along the first direction X.

The contents disclosed in the above embodiment and modification can be executed in appropriate combination.

The connector according to the embodiment includes the packing that includes the seal portion having the annular shape and the piece portion protruding from the seal portion and having the through-hole, and the fitting portion that holds the terminal, is mounted with the packing, and is fitted to the target to be fitted so that the space between the fitting portion and the target to be fitted is sealed by the packing. The fitting portion includes the first member that includes the cylindrical portion having the outer surface on which the seal portion is mounted, the second member that is attached to the cylindrical portion, the projection portion that is provided in one member of the first member and the second member, is inserted into the through-hole, and includes the tip projecting from the through-hole, and the opening portion that is provided in the other member of the first member and the second member and into which the tip of the projection portion is inserted.

According to the connector of the embodiment, the projection portion provided in one member is inserted into the through-hole of the packing, and the tip of the projection portion is inserted into the opening portion of the other member. Therefore, displacement of the packing is suppressed by the projection portion. In addition, since the tip of the projection portion is inserted into the opening portion of the other member, the piece portion of the packing is not easily detached from the projection portion. Therefore, the connector according to the embodiment has an effect that the detachment of the packing can be more surely suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a packing that includes a seal portion having an annular shape and a piece portion protruding from the seal portion and having a through-hole; and a fitting portion that holds a terminal, is mounted with the packing, and is fitted to a target to be fitted so that a space between the fitting portion and the target to be fitted is sealed by the packing, wherein the fitting portion includes:

a first member that includes a cylindrical portion having an outer surface on which the seal portion is mounted;

a second member that is attached to the cylindrical portion;

a projection portion that is provided in one member of the first member and the second member, is inserted into the through-hole, and includes a tip projecting from the through-hole; and an opening portion that is provided in the other member of the first member and the second member and into which the tip is inserted, and the through-hole is located closer to the target to be fitted than the seal portion is, in a direction in which the fitting portion and the target to be fitted are fitted to each other.

2. The connector according to claim 1, wherein the piece portion includes a base portion that protrudes from the seal portion along the direction in which the fitting portion and the target to be fitted are fitted to each other and a tip portion that protrudes from the base portion toward a center of the seal portion, and the through-hole is formed in the tip portion.

3. The connector according to claim 2, wherein the other member includes a second through-hole that penetrates the other member along the direction in which the fitting portion and the target to be fitted are fitted to each other, one end of the second through-hole being the opening portion, and the projection portion is inserted into the second through-hole.

4. The connector according to claim 3, wherein the first member is a housing that holds the terminal, and the second member is a holder that is fitted to the cylindrical portion.

5. The connector according to claim 2, wherein the first member is a housing that holds the terminal, and the second member is a holder that is fitted to the cylindrical portion.

6. The connector according to claim 1, wherein the other member includes a second through-hole that penetrates the other member along the direction in which the fitting portion and the target to be fitted are fitted to each other, one end of the second through-hole being the opening portion, and the projection portion is inserted into the second through-hole.

7. The connector according to claim 6, wherein the first member is a housing that holds the terminal, and the second member is a holder that is fitted to the cylindrical portion.

8. The connector according to claim 1, wherein the first member is a housing that holds the terminal, and the second member is a holder that is fitted to the cylindrical portion.

9. A connector comprising:

a packing that includes a seal portion having an annular shape and a piece portion protruding from the seal portion and having a through-hole; and a fitting portion that holds a terminal, is mounted with the packing, and is fitted to a target to be fitted so that a space between the fitting portion and the target to be fitted is sealed by the packing, wherein the fitting portion includes:

a first member that includes a cylindrical portion having an outer surface on which the seal portion is mounted;

a second member that is attached to the cylindrical portion;

a projection portion that is provided in one member of the first member and the second member, is inserted into the through-hole, and includes a tip projecting from the through-hole; and an opening portion that is provided in the other member of the first member and the second member and into which the tip is inserted, the piece portion includes a base portion that protrudes from the seal portion along the direction in which the fitting portion and the target to be fitted are fitted to each other and a tip portion that protrudes from the base portion toward a center of the seal portion, and the through-hole is formed in the tip portion.

10. A connector comprising:

a packing that includes a seal portion having an annular shape and a piece portion protruding from the seal portion and having a through-hole; and a fitting portion that holds a terminal, is mounted with the packing, and is fitted to a target to be fitted so that a space between the fitting portion and the target to be fitted is sealed by the packing, wherein the fitting portion includes:

a first member that includes a cylindrical portion having an outer surface on which the seal portion is mounted;

a second member that is attached to the cylindrical portion;

a projection portion that is provided in one member of the first member and the second member, is inserted into the through-hole, and includes a tip projecting from the through-hole; and an opening portion that is provided in the other member of the first member and the second member and into which the tip is inserted, the other member includes a second through-hole that penetrates the other member along the direction in which the fitting portion and the target to be fitted are fitted to each other, one end of the second through-hole being the opening portion, and the projection portion is inserted into the second through-hole.

* * * * *